US006948908B2

(12) United States Patent
Jung et al.

(10) Patent No.: US 6,948,908 B2
(45) Date of Patent: Sep. 27, 2005

(54) COOL AIR CIRCULATION BLOWER FOR REFRIGERATOR

(75) Inventors: Young Gyu Jung, Kyungki-do (KR); Chang Joon Kim, Seoul-si (KR)

(73) Assignee: LG Electronics Inc., Seoul (KR)

( * ) Notice: Subject to any disclaimer, the term of this patent is extended or adjusted under 35 U.S.C. 154(b) by 65 days.

(21) Appl. No.: 10/608,065

(22) Filed: Jun. 30, 2003

(65) Prior Publication Data

US 2004/0099000 A1 May 27, 2004

(30) Foreign Application Priority Data

Nov. 25, 2002 (KR) ..... 10-2002-0073533
Dec. 2, 2002 (KR) ..... 10-2002-0075978

(51) Int. Cl.[7] ..... F04D 29/00

(52) U.S. Cl. ..... 415/169.2; 415/169.4; 262/419

(58) Field of Search ..... 415/169.2–4, 173.1, 415/220, 235, 202–6; 416/189, 223; 417/423.14–15; 62/262, 419

(56) References Cited

U.S. PATENT DOCUMENTS 6,511,287 B2 * 1/2003 Kim ..... 415/204
6,584,799 B2 * 7/2003 Jung et al. ..... 62/419

* cited by examiner

*Primary Examiner*—Christopher Verdier
(74) *Attorney, Agent, or Firm*—Greenblum & Bernstein, P.L.C.

(57) ABSTRACT

Disclosed herein is a cool air circulating blower for a refrigerator. The blower comprises a blowing fan for blowing cool air, a motor for driving the blowing fan, and a shroud for guiding the cool air leaving the blowing fan. The shroud is designed to suppress generation of turbulence in such a manner that the cool air leaving the blowing fan is dispersed quickly and condensed water obtained by condensation of moisture laden in the cool air is guided to some places other than the motor, whereby the noise caused due to the turbulence is reduced, the power consumption is decreased, the blowing efficiency is improved, and any breakdown of the motor due to the condensed water is prevented.

7 Claims, 8 Drawing Sheets

COOL AIR CIRCULATION BLOWER FOR REFRIGERATOR

BACKGROUND OF THE INVENTION

1. Field of the Invention

The present invention relates to a cool air circulating blower for a refrigerator, and more particularly to a cool air circulating blower for a refrigerator that is capable of quickly dispersing air flow leaving a blowing fan to reduce generation of turbulence and stopping condensed water obtained by condensation of moisture laden in the cool air from dropping onto a motor for rotating the blowing fan to prevent any breakdown of the motor due to the condensed water.

2. Description of the Related Art

Generally, a refrigerator stores foodstuffs in a fresh state for a long time using cool air obtained by a refrigerating cycle. The cool air is used to cool down the foodstuffs or prevent any decomposition of the foodstuffs. A cool air circulating blower is disposed in a flow channel through which the cool air is circulated for blowing the cool air to a chilling chamber or a freezing chamber.

FIG. 1 is a side view, in longitudinal section, of a general refrigerator. FIG. 2 is an exploded perspective view of a conventional cool air circulating blower for a refrigerator, and FIG. 3 is a front view, in longitudinal section, of the conventional cool air circulating blower for the refrigerator.

As shown in FIG. 1, the refrigerator basically comprises a outer case 1 having an open front part, an inner case 2 disposed in the outer case 1 and spaced apart from the outer case 2, a chilling chamber A mounted at the upper part in the inner case 2, a freezing chamber B mounted at the lower part in the inner case 2, a machinery chamber C provided below the freezing chamber B, a door 3 pivotably attached at the upper front part to the outer case 1, and another door 4 pivotably attached at the lower front part to the outer case 1.

Between the outer case 1 and the inner case 2 is defined a flow channel, through which the cool air is supplied to the chilling chamber A or the freezing chamber B. In the flow channel at the freezing chamber B is mounted an evaporator 5 for producing the cool air by heat exchange with atmospheric air. In the flow channel above the evaporator 5 is mounted a blower 10 for upwardly blowing the cool air having passed through the evaporator 5.

In the machinery chamber C are mounted a compressor 6 connected to the evaporator 5 via a refrigerant pipe, a condenser (not shown), and an expander (not shown), all of which constitute a refrigerating cycle together with the evaporator 5 mounted in the flow channel defined between the outer case 1 and the inner case 2. With operation of the refrigerating cycle, the blower 10 is also operated such that air passing through the evaporator 5 is cooled down, and the resulting cool air is supplied to the chilling chamber A or the freezing chamber B. Consequently, the chilling chamber A or the freezing chamber B are maintained at low temperatures, respectively.

As shown in FIGS. 2 and 3, the blower 10 comprises a shroud 12 for guiding the flow of the cool air, a blowing fan 14 rotatably mounted inside the shroud 12 for blowing the cool air, a motor 16 with a rotating shaft 15 connected to the blowing fan 14 for rotating the blowing fan 14, and a motor supporting bracket 18 integrally formed beneath the shroud 12 for fixedly supporting the motor 16.

The shroud 12, the surface of which is even, is mounted horizontally in the flow channel. The shroud 12 comprises a central hole 12*h* formed through the shroud 12, inside which the blowing fan 14 is disposed, and a bell mouth 12*a* formed in the shape of a circular groove and provided around the central hole 12*h* for guiding the flow of the cool air.

When the blowing fan 14 is operated, the cool air having passed through the evaporator 5 is guided by means of the bell mouth 12*a* and passes through the blowing fan 14. The cool air is mainly blown from below the blowing fan 14 to above the blowing fan 14 so that the cool air is supplied to the chilling chamber A and the freezing chamber B.

Specifically, the cool air enters the blowing fan 14 in the radial direction of the blowing fan 14 below the shroud 12, and leaves the blowing fan 14 in the radial direction of the blowing fan 14 above the shroud 12.

The cool air having passed through the blower 10 contains condensed water laden therein. The resulting condensed water drops onto the shroud 12 owing to its own weight, or condenses on the shroud 12. Especially, the condensed air is gathered in the bell mouth 12*a* formed in the shape of a circular groove since the bottom of the circular groove is lower than the top surface of the shroud 12.

In the conventional cool air circulating blower for the refrigerator, the blowing fan 14 for blowing the cool air is mounted inside the shroud 12 such that the plane of rotation of the blowing fan 14 is level with the shroud 12, the surface of which is planar. Consequently, the cool air leaving the blowing fan 14 in the radial direction of the blowing fan 14 is blown against the shroud 12 to generate turbulence. This turbulence causes noise and reduction in the flow rate of the cool air, with the result that the reliability of the blower is impaired, the blowing efficiency is decreased, and the power consumption is increased.

Furthermore, in the conventional cool air circulating blower for refrigerators, the cool air having passed through the evaporator 5 passes through the shroud 12 and is supplied upwardly with the operation of the blowing fan 14. Consequently, the condensed water obtained by condensation of moisture laden in the cool air condenses on the shroud 12. Especially, the condensed water is gathered in the bell mouth 12*a* formed in the shape of a circular groove since the bottom of the circular groove is lower than the top surface of the shroud 12.

In consequence, an increasing amount of condensed water is gathered in the bell mouth 12*a* as the refrigerator is repeatedly operated, and finally the condensed water gathered in the bell mouth 12*a* overflows and then drops onto the motor 16 mounted below the shroud 12 through the central hole 12*h*, whereby the motor is damaged, and thus the reliability of the refrigerator itself is impaired.

SUMMARY OF THE INVENTION

Therefore, the present invention has been made in view of the above problems, and it is an object of the present invention to provide a cool air circulating blower for a refrigerator that is capable of quickly dispersing air flow leaving a blowing fan in the radial direction of the blowing fan to reduce generation of turbulence and guiding condensed water obtained by condensation of moisture laden in the cool air and having dropped onto a shroud to some places other than a motor to prevent any breakdown of the motor due to the condensed air.

In accordance with one aspect of the present invention, the above and other objects can be accomplished by the provision of a cool air circulating blower for a refrigerator comprising: a blowing fan connected to a motor via a rotating shaft of the motor for blowing cool air with rotation of the motor; a shroud having a central hole formed therethrough for guiding air flow, the blowing fan being disposed inside the central hole; and air flow guiding means formed around the central hole of the shroud for dispersing air flow leaving the blowing fan in the radial direction of the blowing fan to reduce generation of turbulence.

In accordance with another aspect of the present invention, there is provided a cool air circulating blower for a refrigerator comprising: a blowing fan for upwardly blowing cool air; a shroud having a central hole formed therethrough and disposed horizontally for guiding air flow, the blowing fan being disposed inside the central hole of the shroud; a motor mounted below the blowing fan and connected to the blowing fan via a rotating shaft of the motor; and draining means formed at the shroud for guiding and draining condensed water obtained by condensation of moisture laden in the cool air and having dropped onto the shroud to some places other than the motor.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
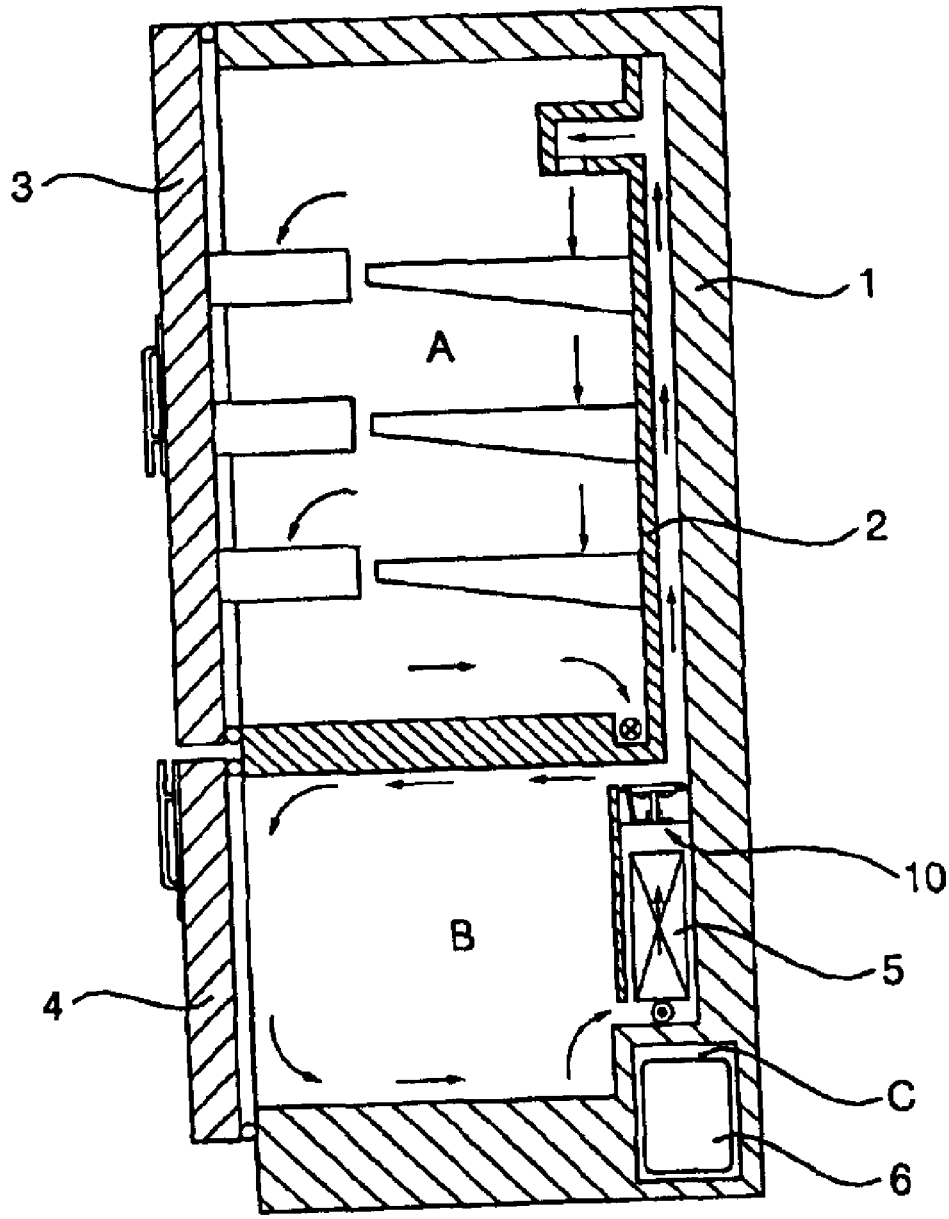
FIG. 1(Prior Art)
FIG. 1 is a side view, in longitudinal section, of a general refrigerator.
Figure 2:
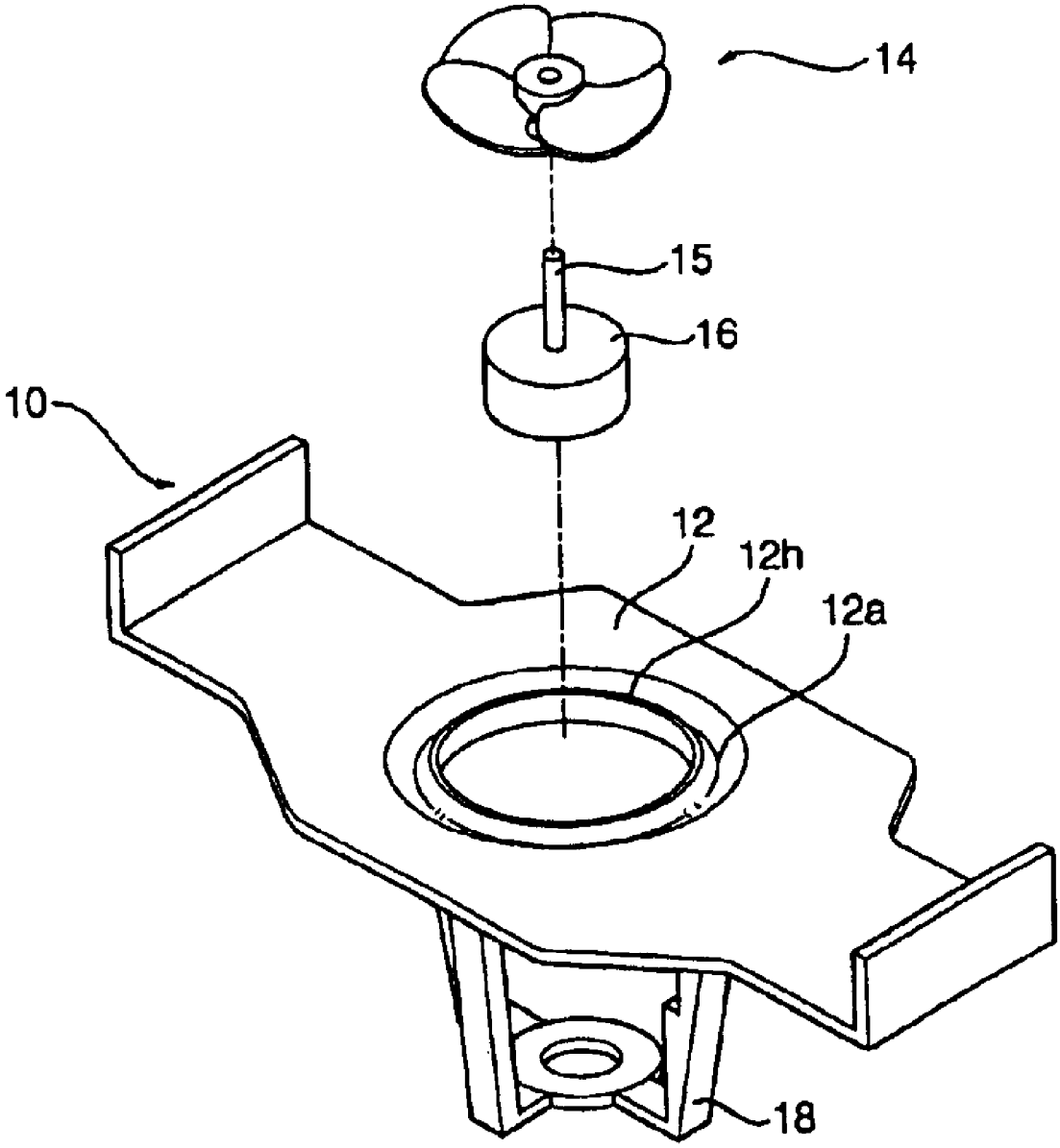
FIG. 2(Prior Art)
FIG. 2 is an exploded perspective view of a conventional cool air circulating blower for a refrigerator.
Figure 3:
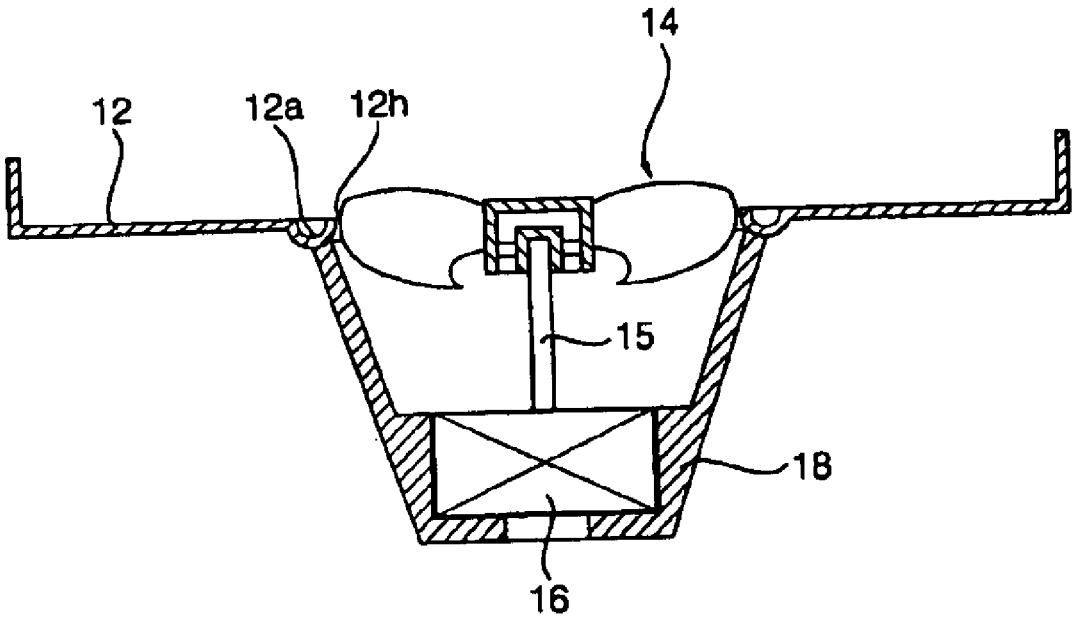
FIG. 3(Prior Art)
FIG. 3 is a front view, in longitudinal section, of the conventional cool air circulating blower for the refrigerator.
Figure 4:
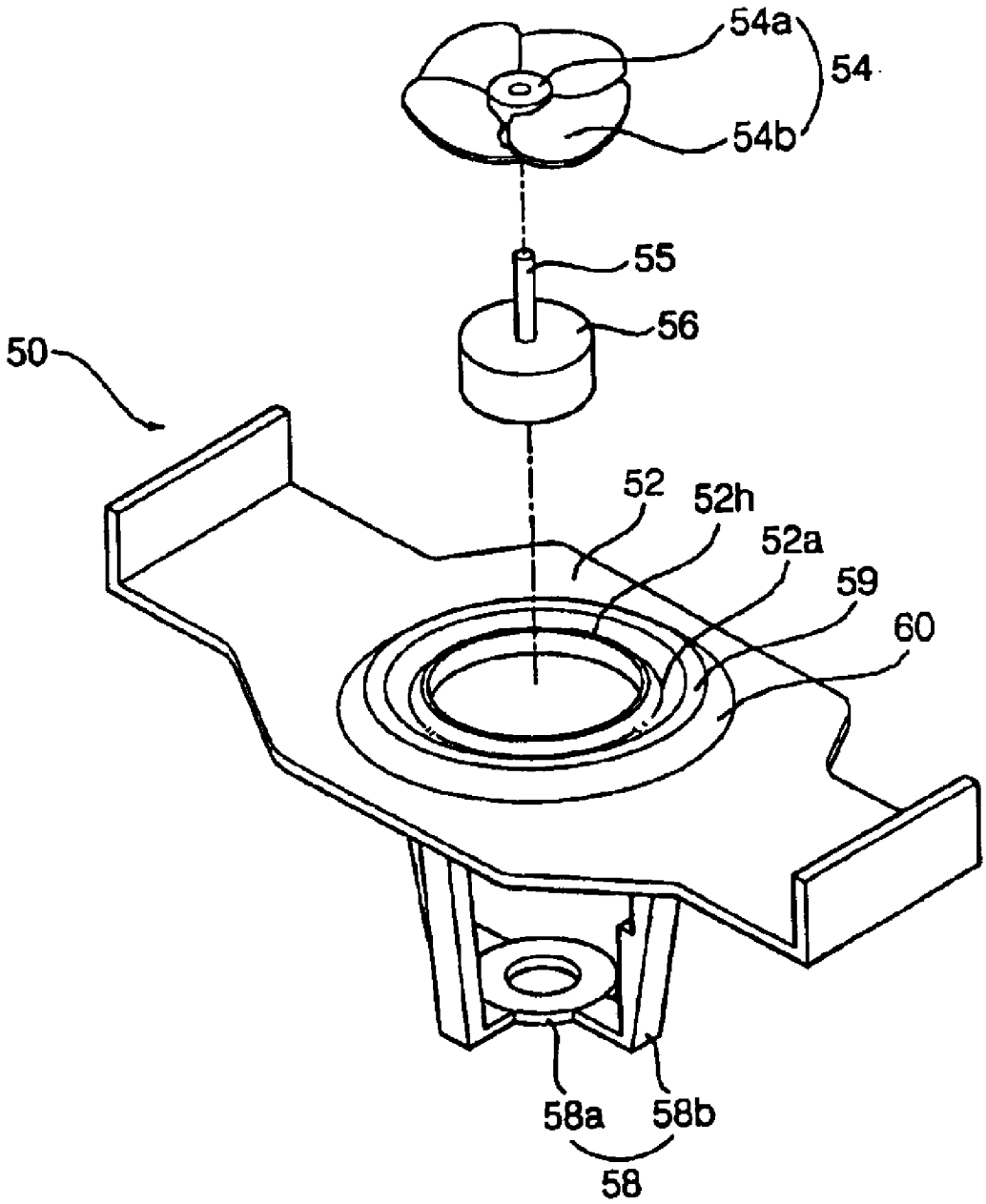
FIG. 4 is an exploded perspective view of a cool air circulating blower for a refrigerator according to a first preferred embodiment of the present invention.
Figure 5:
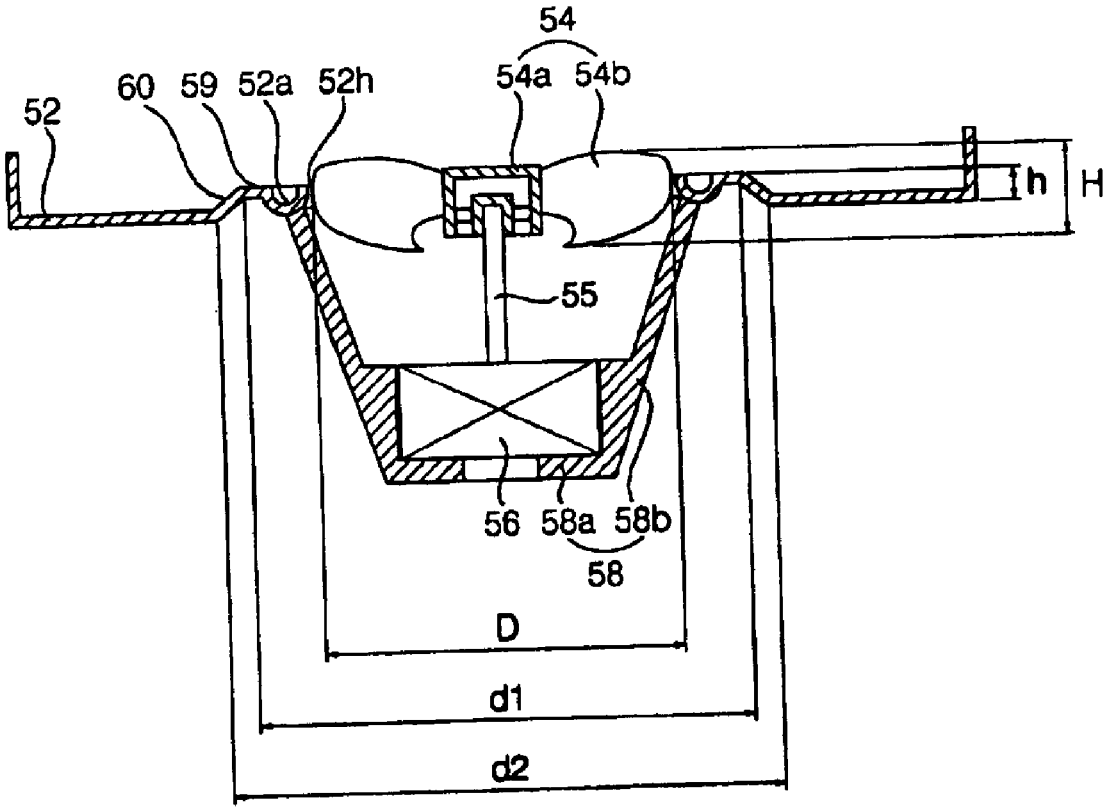
FIG. 5 is a front view, in longitudinal section, of the cool air circulating blower for the refrigerator according to the first preferred embodiment of the present invention.

FIG. 4 is an exploded perspective view of a cool air circulating blower for a refrigerator according to a first preferred embodiment of the present invention, and FIG. 5 is a front view, in longitudinal section, of the cool air circulating blower for the refrigerator according to the first preferred embodiment of the present invention.

The cool air circulating blower for the refrigerator according to the present invention is disposed in a flow channel defined between a outer case (not shown) constituting an exterior of the refrigerator and an inner case (not shown) disposed in the outer case and spaced apart from the outer case. As shown in FIGS. 4 and 5, the cool air circulating blower comprises a shroud 52 having a central hole 52*h* formed therethrough and disposed horizontally in the flow channel for guiding air flow, a blowing fan 54 disposed inside the central hole 52*h* of the shroud 52 for upwardly blowing cool air, a motor 56 mounted below the blowing fan 54 and connected to the blowing fan 54 via a rotating shaft 55 of the motor 56 for rotating the blowing fan 54, a motor supporting bracket 58 integrally formed beneath the shroud 52 for fixing the motor 56 to the shroud 52, and air flow guiding means formed on the top surface of the shroud 52 for dispersing air flow leaving the blowing fan 54 in the radial direction of the blowing fan 54 to reduce generation of turbulence.

The shroud 52 has the central hole 52*h* formed through the middle portion of the shroud, inside which the blowing fan 54 is disposed, and a bell mouth 52*a* formed in the shape of a circular groove and provided around the central hole 12*h* for guiding the flow of the cool air entering the blowing fan 54.

The blowing fan 54 is a kind of axial flow fan comprising a hub 54*a* connected to the motor via the rotating shaft 55 of the motor for transmitting the rotating force of the motor, the hub 54*a* including a front end and a rear end having the same diameter as the front end to guide the air flow in the radial direction of the hub 54*a*, and a plurality of equally spaced blades 54*b* attached on the outer circumference of the hub 54*a* for blowing the cool air in the radial direction of the blowing fan 54. The blowing fan 54 is horizontally disposed inside the central hole 52*h* with a prescribed gap between the blades 54*b* of the blowing fan 54 and the central hole 52*h* of the shroud 52 for blowing the cool air from below the blowing fan 54 to above the blowing fan 54.

The motor supporting bracket 58 comprises a main supporting body 58*a* disposed apart below the central hole 52*h* for fixing the motor 56, and three supporting bars 58*b* connected between the main supporting body 58*a* and the edge of the central hole 52*h*.

The supporting bars 58*b* connected between the main supporting body 58*a* and the edge of the central hole 52*h* are disposed in such a manner that a prescribed angle is provided between one of the supporting bars 58*b* and the neighboring supporting bar, considering the flow characteristic of air entering the blowing fan 54.

For example, the angles between two neighboring supporting bars of the supporting bars 58*b* are set to 110° C., 110° C., and 140° C., respectively, which minimizes their interference of the air flow entering the blowing fan 54.

The air flow guiding means comprises an air flow guiding surface 60 formed apart around the bell mouth 52*a* and inclined downwardly in the radial direction thereof in case that the shroud 52 is mounted horizontally.

Since the air flow guiding surface 60 is formed apart around the bell mouth 52*a*, there is provided a horizontal portion 59 formed in the shape of a plane around the bell mouth 52*a*. The air flow guiding surface 60 is formed around the horizontal portion 59.

The air flow guiding surface 60 may have a downwardly inclined planar shape or a downwardly inclined concave shape, any of which is suitable to guide the air flow leaving the blowing fan 54 in the radial direction of the blowing fan 54.

The size of the air flow guiding surface 60 may be adjusted on the basis of the size of the blowing fan 54.

Specifically, the ratio of the height h of the air flow guiding surface 60 to the height H of the blowing fan 54 is 30%–50%, the ratio of the diameter D of the blowing fan 54 to the inner diameter d1 of the air flow guiding surface 60 is 65%–75%, and the ratio of the inner diameter d1 of the air flow guiding surface 60 to the outer diameter d2 of the air flow guiding surface 60 is 85%–95%.

The size of the air flow guiding surface 60 is experimentally determined to generate minimal turbulence on the basis of the size of the blowing fan 54.

The operation of the cool air circulating blower for refrigerators with the above-stated construction according to the first preferred embodiment of the present invention will now be described.

When the refrigerator is operated, refrigerant is circulated through the compressor (not shown), through the condenser (not shown), through the evaporator (not shown), and through the expander (not shown). When the blower 50 mounted to the evaporator is operated, the cool air obtained by heat exchange with the refrigerant while passing through the evaporator is supplied to the chilling chamber or the freezing chamber.

The blowing fan 54 of the blower 50 is rotated with operation of the motor 56. When the blowing fan 54 is rotated, the cool air having passed through the evaporator flows upwardly by means of the blowing fan 54. The cool air enters the blowing fan 54 from below the shroud 52 by means of the blowing fan 54, and leaves the blowing fan above the shroud 52 by means of the blowing fan 54.

At this time, most of the cool air leaving the blowing fan 54 flows in the axial direction of the blowing fan 54, and the remainder of the cool air flows in the radial direction of the blowing fan 54. The cool air flowing in the radial direction of the blowing fan 54 is blown against the shroud 12, whereby turbulence is generated around the central hole 52*h*.

Since the air flow guiding surface 60 is formed apart around the central hole 52*h*, however, the cool air flowing in the radial direction of the blowing fan 54 is moved quickly down the air flow guiding surface 60 where the pressure is relatively low. As a result, the turbulence is dispersed along the air flow guiding surface 60 together with the air flow leaving the blowing fan 54 even if the turbulence is generated around the central hole 52*h*.

Consequently, the turbulence is dispersed along the air flow guiding surface 60 even if the turbulence is generated due to the air flow leaving the blowing fan 54 in the radial direction of the blowing fan 54, whereby the noise caused due to the turbulence is reduced and the reduction in the flow rate of the cool air is reduced, which increases the blowing efficiency.

Figure 6:
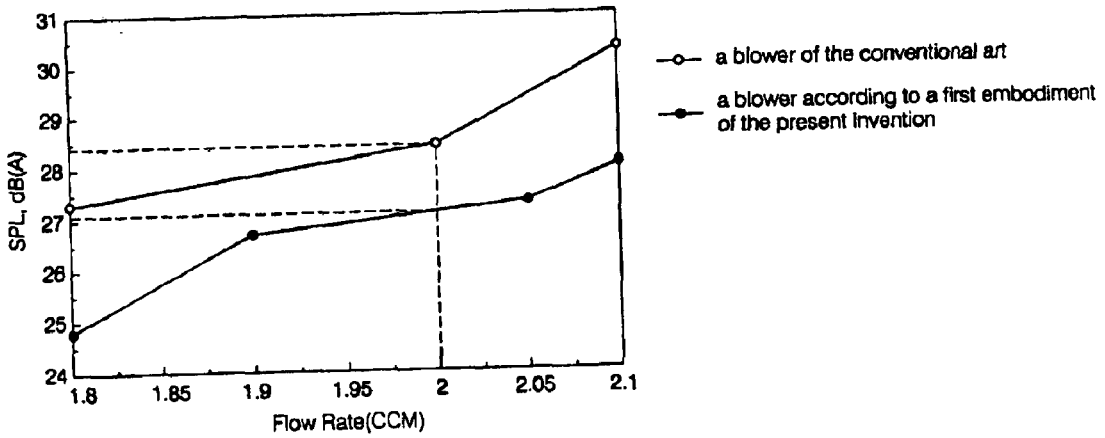
FIG. 6 is a graph illustrating noise levels based on air flow rates of the conventional cool air circulating blower for the refrigerator and the cool air circulating blower for the refrigerator according to the first preferred embodiment of the present invention, respectively.
Figure 7:
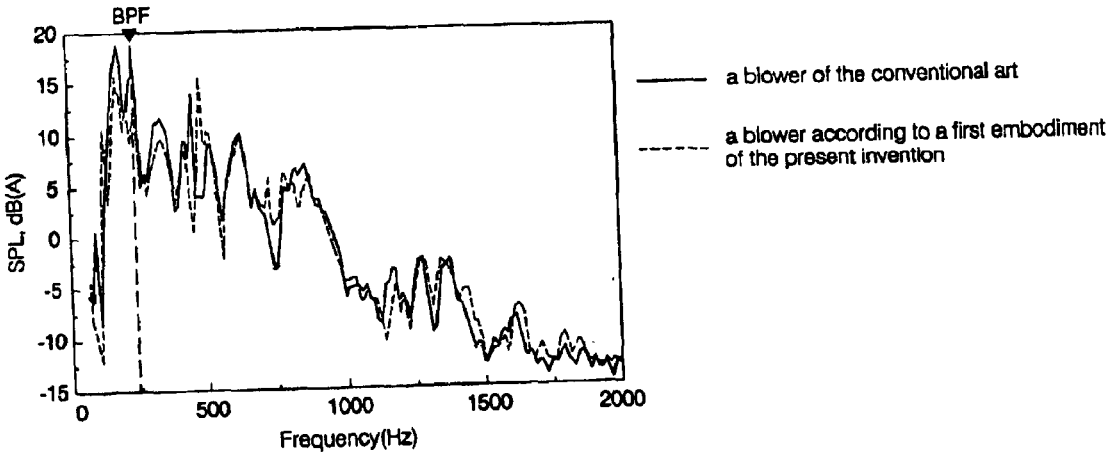
FIG. 7 is a graph illustrating noise levels based on frequencies of the conventional cool air circulating blower for the refrigerator and the cool air circulating blower for the refrigerator according to the first preferred embodiment of the present invention, respectively.

FIG. 6 is a graph illustrating noise levels based on air flow rates of the conventional cool air circulating blower for the refrigerator and the cool air circulating blower for the refrigerator according to the first preferred embodiment of the present invention, respectively, and FIG. 7 is a graph illustrating noise levels based on frequencies of the conventional cool air circulating blower for the refrigerator and the cool air circulating blower for the refrigerator according to the first preferred embodiment of the present invention, respectively.

The conventional cool air circulating blower for the refrigerator having the noise level based on the air flow rate and the noise level based on the frequency as indicated in FIGS. 6 and 7 includes the horizontally formed shroud, whereas the cool air circulating blower for the refrigerator according to the first preferred embodiment of the present invention includes the shroud with the air flow guiding surface of a prescribed rate. The air flow guiding surface according to the present invention is configured in such a manner that the ratio of the height h of the air flow guiding surface to the height H of the blowing fan is 34.8%, the ratio of the diameter D of the blowing fan to the inner diameter d1 of the air flow guiding surface is 71.9%, and the ratio of the inner diameter d1 of the air flow guiding surface to the outer diameter d2 of the air flow guiding surface is 92.6%.

The graph of FIG. 6 indicates that the noise level of the cool air circulating blower for the refrigerator according to the first preferred embodiment of the present invention is 1.5 dB(A) lower than that of the conventional cool air circulating blower for the refrigerator at the same flow rate, and that the flow rate of the cool air circulating blower for the refrigerator according to the first preferred embodiment of the present invention is more than that of the conventional cool air circulating blower for the refrigerator at the same noise level. Also, the graph of FIG. 7 indicates that the peak noise level of the cool air circulating blower for the refrigerator according to the first preferred embodiment of the present invention is remarkably reduced in a specific frequency band, i.e., in the blade passing frequency, as compared with that of the conventional cool air circulating blower for the refrigerator.

Figure 8:
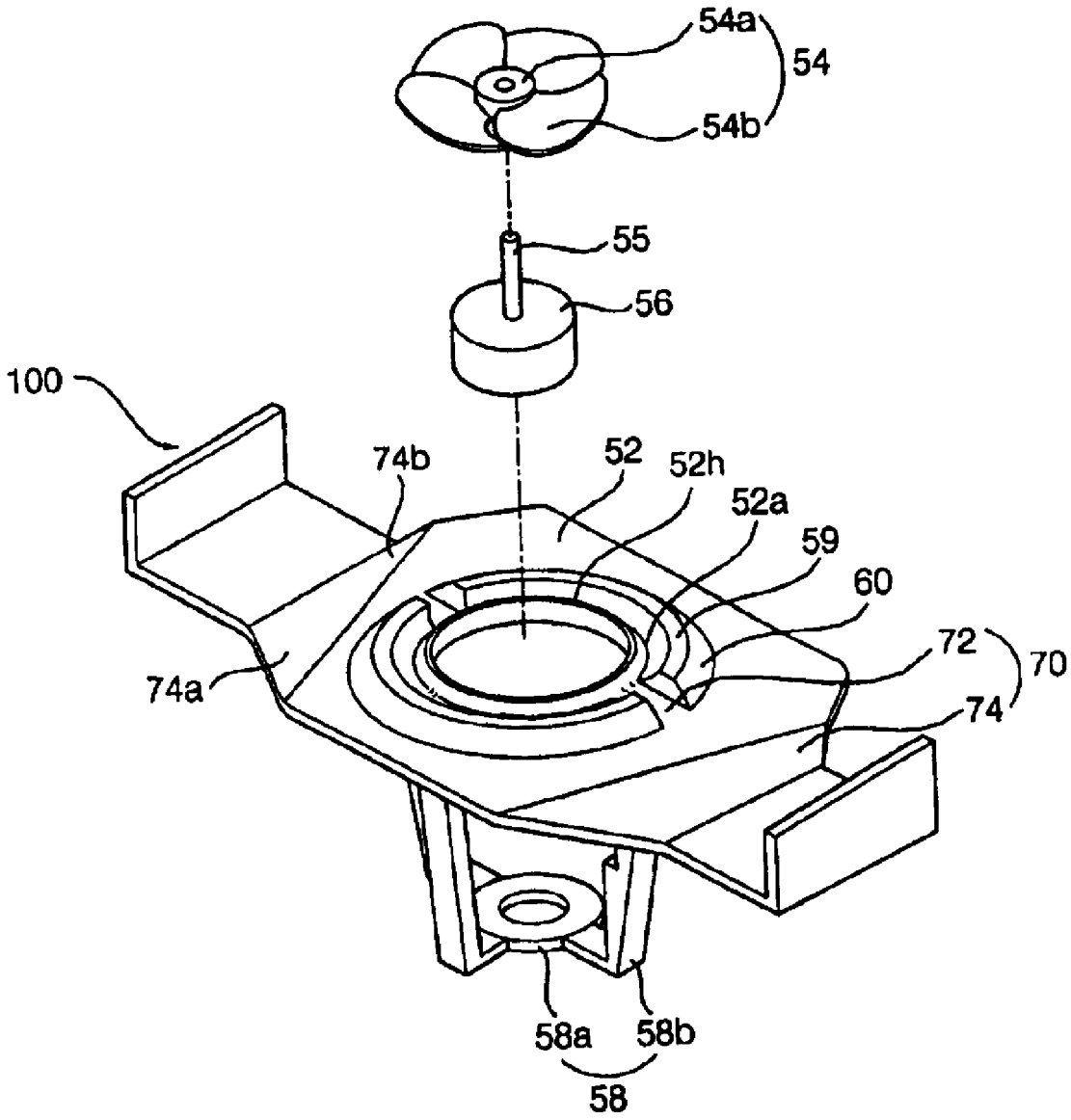
FIG. 8 is an exploded perspective view of a cool air circulating blower for a refrigerator according to a second preferred embodiment of the present invention.
Figure 9:
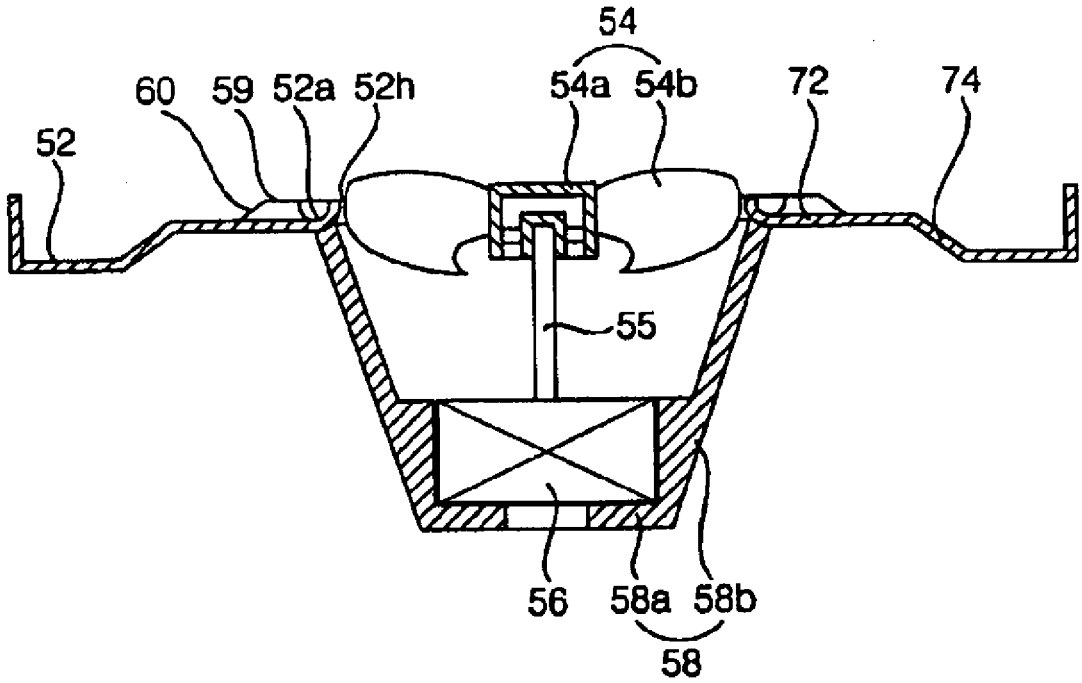
FIG. 9 is a front view, in longitudinal section, of the cool air circulating blower for the refrigerator according to the second preferred embodiment of the present invention.

FIG. 8 is an exploded perspective view of a cool air circulating blower for a refrigerator according to a second preferred embodiment of the present invention, and FIG. 9 is a front view, in longitudinal section, of the cool air circulating blower for the refrigerator according to the second preferred embodiment of the present invention.

The cool air circulating blower for the refrigerator according to the second preferred embodiment of the present invention is similar to the cool air circulating blower for the refrigerator according to the first preferred embodiment of the present invention except that the cool air circulating blower for the refrigerator according to the second preferred embodiment of the present invention further comprises draining means 70 formed at the shroud 52 for guiding and draining the condensed water such that the condensed water gathered on the top surface of the shroud 52 freely drops to places other than the motor 56, as shown in FIGS. 8 and 9.

The cool air circulating blower 100 is disposed in the flow channel defined between the outer case (not shown) and the inner case (not shown) in such a manner that the front end of the shroud 52 is disposed closest to the inner case and the rear end of the shroud 52 is disposed closest to the outer case.

The draining means 70 comprises a draining groove 72 formed at one side on the circumference of the bell mouth 52a in the longitudinal direction of the shroud 52, the draining groove 72 communicating with the bottom surface of the bell mouth 52*a*, and a draining surface 74 connected to the draining groove 72, the draining surface 74 being inclined downwardly in the radial direction of the bell mouth 52*a*.

The draining means 70 may be formed at opposite sides on the circumference of the bell mouth 52*a* in the longitudinal direction of the shroud 52 so that the condensed water is drained outwardly in the opposite directions of the shroud 52, or a horizontal section may be provided between the draining groove 72 and the draining surface 74.

The bottom surface of the draining groove 72 is flush with the bottom surface of the bell mouth 52*a*, and the draining surface 74 is designed in the shape of a downwardly inclined plane so that the condensed water gathered in the bell mouth 52*a* flows down outwardly in the radial direction of the bell mouth 52*a*.

Alternatively, the bottom surface of the draining groove 72 may be inclined downwardly in the radial direction of the bell mouth 52*a*, and the draining surface 74 may be designed in the shape of a downwardly inclined concave so that the condensed water gathered in the bell mouth 52*a* quickly flows down outwardly in the radial direction of the bell mouth 52*a*.

The draining surface 74 traverses the shroud 52 from the front end of the shroud 52 to the rear end of the shroud 52 in such a manner that a front end 74*a* of the draining surface 74 is disposed closest to the inner case and that a rear end 74*b* of the draining surface 74 is disposed closet to the outer case. The rear end 74*b* of the draining surface 74 is inclined more steeply than the front end 74*a* of the draining surface 74, and the draining surface 74 has a gradual downward inclination from the front end 74*a* of the draining surface 74 to the rear end 74*b* of the draining surface 74.

The operation of the cool air circulating blower for the refrigerator with the above-stated construction according to the second preferred embodiment of the present invention will now be described.

The compressor is operated with operation of the refrigerator. When the compressor is operated, refrigerant is circulated through the compressor, through the condenser, through the expander, and through the evaporator. The air around the evaporator is cooled down by heat exchange with the refrigerant passing through the evaporator. When the blower 100 is operated, the cool air having passed through the evaporator is upwardly blown and supplied to the chilling chamber A or the freezing chamber B.

The cool air having passed through the blower 100 contains condensed water laden therein. The resulting condensed water drops onto the top surface of the shroud 52 owing to its own weight, or condenses on the top surface of the shroud 52. The condensed water having dropped onto the top surface of the shroud 52 flows down along the draining surface 74, and the condensed water gathered in the bell mouth 52*a* flows down along the draining groove 72 and the draining surface 74.

The rear end 74*b* of the draining surface 74 is inclined more steeply than the front end 74*a* of the draining surface 74, and the draining surface 74 has a gradual downward inclination from the front end 74*a* of the draining surface 74 to the rear end 74*b* of the draining surface 74, whereby the condensed water is guided to the rear end 74*b* of the draining surface and then flows down along the wall of the outer case.

Consequently, the condensed water flows down outwardly from the shroud 52 so that the condensed water is prevented from dropping onto the motor 56 mounted below the central hole 52*h*, and thus any breakdown of the motor due to the condensed air is prevented.

As apparent from the above description, the present invention provides a cool air circulating blower for a refrigerator having an air flow guiding surface formed around a central hole of a shroud, inside which a blowing fan is disposed, wherein turbulence is dispersed quickly down the air flow guiding surface where the pressure is relatively low even if air flow leaving the blowing fan is blown against the shroud to generate the turbulence, whereby the noise caused due to the turbulence is reduced, the reduction in the flow rate of the cool air due to the turbulence is reduced, the blowing efficiency is improved, and the power consumption is decreased.

Furthermore, there is provided a cool air circulating blower for a refrigerator comprising a bell mouth formed around a central hole of a shroud for guiding the flow of cool air, inside which a blowing fan is disposed, and a draining groove and a draining surface formed at the shroud for guiding and draining condensed water such that the condensed water dropping onto the bell mouth or the top surface of the shroud freely falls down outwardly in the longitudinal direction of the shroud, wherein the condensed water does not fall down to a motor but is drained outside the shroud along the draining groove and the draining surface even if the condensed water obtained by condensation of moisture laden in the cool air with operation of the refrigerator drops onto the bell mouth or the top surface of the shroud, whereby any breakdown of the motor due to the condensed air is prevented, and the reliability of products equipped with the cool air circulating blower according to the present invention is improved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cool air circulating blower for a refrigerator, comprising:

a blowing fan that blows cool air upwardly;

a shroud having a central hole formed therethrough and disposed horizontally for guiding air flow, the blowing fan being positioned within the central hole of the shroud;

a motor mounted below the blowing fan and connected to the blowing fan via a rotating shaft of the motor; and a draining device provided at the shroud that guides condensed water obtained by condensation of moisture in the cool air that has dropped onto the shroud conveys the condensed water to places other than the motor, wherein the shroud further comprises a bell mouth provided around the central hole in the shape of a circular groove that guides the flow of the cool air, and wherein the draining device comprises a draining groove provided at one side on the circumference of the bell mouth in the longitudinal direction of the shroud, the draining groove communicating with a bottom surface of the bell mouth.

2. The blower as set forth in claim 1 wherein a bottom surface of the draining groove is flush with the bottom surface of the bell mouth.

3. The blower as set forth in claim 1 wherein a bottom surface of the draining groove is inclined downwardly in a radial direction of the bell mouth.

4. The blower as set forth in claim 1 wherein the draining device further comprises a draining surface connected to the draining groove; the draining surface being inclined downwardly in a radial direction of the bell mouth.

5. The blower as set forth in claim 4, wherein the draining surface has a front end and a rear end inclined more steeply than the front end, whereby the condensed water is guided to the rear end of the draining surface and then flows down along the wall of an outer case when the shroud is disposed in a flow channel defined between the outer case and an inner case, and the front end of the draining surface is disposed closest to the inner case and the rear end of the draining surface is disposed closest to the outer case.

6. The blower as set forth in claim 5, wherein the draining surface has a gradual downward inclination from the front end of the draining surface to the rear end of the draining surface.

7. A cool air circulating blower for a refrigerator, comprising:

a blowing fan that blows cool air upwardly;

a shroud having a central hole formed therethrough and disposed horizontally for guiding air flow, the blowing fan being positioned within the central hole of the shroud;

a motor mounted below the blowing fan and connected to the blowing fan via a rotating shaft of the motor; and a draining device provided at the shroud that guides condensed water obtained by condensation of moisture in the cool air that has dropped onto the shroud and conveys the condensed water to places other than the motor, wherein the shroud further comprises a bell mouth provided around the central hole in the shape of a circular groove that guides the flow of the cool air, and wherein the draining device comprises a pair of draining grooves provided at the opposite sides on the circumference of the bell mouth in the longitudinal direction of the shroud, the draining grooves communicating with a bottom surface of the bell mouth.

* * * * *